US006126582A

United States Patent [19]

Dangelmayr et al.

[11] Patent Number: 6,126,582

[45] Date of Patent: Oct. 3, 2000

[54] TRANSFER PRESSES WITH AN AUTOMATIC TOOLING CHANGE

[75] Inventors: Andreas Dangelmayr, Ottenbach; Karl Thudium, Waeschenbeuren, both of Germany

[73] Assignee: Schuler Pressen GmbH & Co., Goeppingen, Germany

[21] Appl. No.: 09/152,346

[22] Filed: Sep. 14, 1998

[30] Foreign Application Priority Data

Sep. 13, 1997 [DE] Germany ..... 197 40 293

[51] Int. Cl.[7] ..... B23Q 3/155; B21D 43/05

[52] U.S. Cl. ..... 483/28; 72/405.13

[58] Field of Search ..... 483/28, 29; 72/405.01, 72/405.13, 405.14, 405.16, 405.11, 446

[56] References Cited

U.S. PATENT DOCUMENTS

| | | | |
|---|---|---|---|
| 4,741,195 | 5/1988 | Arai et al. | 72/421 |
| 4,819,786 | 4/1989 | Tanaka et al. | 72/405.13 X |
| 4,932,235 | 6/1990 | Rieger et al. | 72/405.13 |
| 5,248,288 | 9/1993 | Kamiya et al. . | |
| 5,582,061 | 12/1996 | Harsch et al. | 72/405.1 |
| 5,584,205 | 12/1996 | Harsch et al. | 72/405.02 |
| 5,617,756 | 4/1997 | Thudium et al. | 72/405.16 |

FOREIGN PATENT DOCUMENTS

| | | |
|---|---|---|
| 0 384 188 A2 | 8/1990 | European Pat. Off. . |
| 0 818 254 A2 | 1/1998 | European Pat. Off. . |
| 38 43 975 C1 | of 0000 | Germany . |
| 42 08 205 A1 | 10/1992 | Germany . |
| 2 199 781 | 11/1987 | United Kingdom . |

*Primary Examiner*—William Briggs
*Attorney, Agent, or Firm*—Evenson McKeown Edwards & Lenahan, P.L.L.C.

[57] ABSTRACT

A multistation press has a transfer device with cross traverses. The transfer device is set up for an automatic tooling change by providing that the cross traverses or the tooling held thereon are to be deposited on passive tooling receiving devices on sliding tables. This deposition takes place without the aid of transfer units in that a control device activates a height adjusting device independently of the other driving devices for the workpiece transfer such that the cross traverses are lowered to the passive tooling receiving devices.

12 Claims, 6 Drawing Sheets

TRANSFER PRESSES WITH AN AUTOMATIC TOOLING CHANGE

BACKGROUND OF THE INVENTION

The present invention relates to a multistation press or a comparable forming machine having a plurality of working stations arranged one behind another in a transport direction and through which workpieces successively pass, tables arranged to be movable out of the working stations and equipped with devices for receiving tools and carrying tooling receiving devices, a transfer device for transporting the workpieces among the working stations, the transfer device having at least two carrying rails extending essentially parallel to the transport direction, cross traverses operatively arranged between the carrying rails and carrying a tooling with holding devices for controlled holding and releasing of the workpieces, at least one driving device configured to move the cross traverses on a defined transfer curve and having height adjusting devices configured to permit vertical adjustment of the cross traverses, and rotary drive devices for controlled rotation of the holding devices about an axis oriented transversely with respect to the transport direction, a control device configured to control at least operation of the height adjusting device and of the rotary drive devices.

In multistation presses or comparable forming machines, particularly transfer presses, the tools must be changeable. The tools include top and bottom tools which are arranged in individual press stations for machining sheet metal parts. While the top tool is held on the press slide, the bottom tool is mounted on a so-called sliding table which can be moved laterally out of the press. For the tool change, the top tool has been deposited on the bottom tool so that the complete tool can be moved out of the multistation or transfer press by means of the sliding table.

In addition to the actual tools, the transfer press has additional workpiece-specific devices. These include parts of the transfer press which have the purpose of further transporting the sheet metal parts from one press station to the next. The transfer system is constructed, for example, as a two-rail transfer. Two carrying rails extend on both sides of the press stations longitudinally through the transfer press. Moving carriages are disposed on the carrying rails, between which moving carriages cross traverses are held. By way of driving cams and corresponding transmitting devices, the carrying rails are subjected to a lifting/lowering movement, and the moving carriages are subjected to a backward and forward movement such that the cross traverses travel through a desired transfer curve.

The cross traverses carry devices for the receiving or holding and the controlled releasing of workpieces. These devices are, for example, vacuum-operated suction devices which are arranged on the ends of corresponding suction arms. These suction device arrangements are also called suction spiders. The arrangement of the suction devices, i.e., the construction of the suction spiders, is tool-specific. The suction spiders are therefore part of the workpiece-specific tooling which must also be changed during the tool exchange.

German Patent 3843975 C1 discloses a transfer device for a transfer press having horizontally and vertically moved carrying rails. Between the carrying rails, cross traverses are held which, by way of actuators provided on the carrying rails, can be swivelled in a limited areas about their transverse axis. The cross traverses carry a workpiece-specific tooling and must be exchanged during the tool change. The tools arranged in the press stations are held on sliding tables which can be moved laterally out of the press. On the sliding tables, so-called alignment pins are held which are constructed vertically adjustably by pressure media, i.e., have an active construction. For the tool change, the alignment pins are adjusted upwards approaching the cross traverses to be accommodated. They receive the cross traverses and are then lowered again. However, hydraulically operated active alignment pins disadvantageously require a pressure medium connection to the sliding table and the alignment pins.

In addition, DE 4208205 A1 describes an arrangement for transfer presses for the exchange of workpiece holders (tooling) which requires only passive tooling depositing devices. For the transfer of the cross traverses from the transfer system to the alignment pins, a transfer unit is provided which can be adjusted in its height and in its longitudinal direction. This transfer unit is formed by a vertical pressure cylinder whose piston rod carries the receiving device for the cross traverses and whose cylinder is adjustably arranged by a parallelogram guide in a force-actuated manner on a circular-arc-shaped path. In addition, swivel movements can be carried out. This transfer unit requires, however, additional installation space and additional constructional expenditures.

SUMMARY OF THE INVENTION

An object of the present invention is to provide a multistation press or a comparable forming machine in the case of which a tooling exchange is achieved in a simple manner with low constructional expenditures.

This object has been achieved in accordance with the present invention by providing a press with a control device for depositing the cross traverses and/or the tooling held by the cross traverses during the tool change, the rotary drive device causing the tooling to be lowered into a depositing position, and the height adjusting device having the effect that, for the transfer of the cross traverses and/or of the tooling to the tooling receiving devices, the carrying rails are lowered vertically to the position of the tooling receiving devices.

The multistation press according to the present invention does not require a separate transfer unit for transferring the tooling from the transfer system to tooling receiving devices (alignment pins). The control device of the multistation press controls or monitors at least the driving device for moving the cross traverses on a defined transfer curve as well as additional height adjusting devices by way of which the height of the carrying rails is adjustable.

During the operation of the transfer device, the driving device moves moving carriages disposed on the carrying rails in the transport direction, i.e., into the longitudinal direction of the press. In addition, the driving device moves the carrying rails in the vertical direction so that, as the result of the superposition of both movement components, a transfer curve is formed through which the cross traverses travel.

The additional height adjusting device permits the adjustment of the level of the transfer curve. The control device utilizes the height adjusting device in order to deposit the cross traverses with the tooling held thereon or to deposit the tooling without the cross traverses on the tooling receiving devices. The tooling receiving devices are carried by the sliding tables. That is, the tooling receiving devices can be fastened on the sliding table itself as well as on the tool disposed on the sliding table. A transfer unit is unnecessary. This arrangement permits a space-saving construction of the entire multistation press. In addition, the use of passive alignment pins (tooling receiving devices) eliminates a pressure medium feeding to the tooling receiving devices which otherwise would be connected with additional expenditures.

The tooling is rotatably held in the transfer device. The transfer device has corresponding rotary drive devices for swivelling the tooling about its transverse axis into different tilted positions. The rotary drive devices are constructed to swivel the tooling into a horizontal working position as well as into a vertical alignment position. Thus the possible swivel area of the tooling amounts to at least 90° and is preferably clearly larger (for example, 180°). As a result, different tilted positions situated in the proximity of the horizontal position and, in addition, a vertical alignment position can be taken up.

The control device controls the rotary drive device to adjust the desired tooling position as well as the driving device for the transfer curve and the height adjusting device.

The driving device for the transfer curve is preferably formed by cam plates which are connected with the main drive of the forming machine or multistation press. With respect to its control effect, the control device can be limited to stopping the driving device, i.e., the main drive, in a position in which the cross traverses are situated above the workpiece receiving devices. As required, the cam plates can also be positioned separately by corresponding coupling and driving devices at least during the tool change.

The cross traverse with the tooling as well as only the tooling carried by the cross traverses on the tooling receiving devices. Correspondingly, the coupling devices to be detached during the tooling exchange are arranged between the cross traverses can be deposited and moving carriages disposed on the carrying rails or between the tooling and the cross traverses. The coupling devices are also controlled by the control device.

For rotating the tooling, the rotary drive devices may be arranged on the moving carriages. As an alternative, the rotary drive devices may also be part of the cross traverses so that a section of the cross traverses carrying the tooling rotates with respect to the ends of the cross traverses which are held. by coupling devices on the moving carriages. In this case, the rotary drive devices are integrated in the cross traverse.

In addition, the tooling can be provided with rotary drives. For example, suction devices are detachably held on the cross traverses and hold suction arms in a swivellable manner by way of corresponding curved guides and rotary drives. This novel approach has the advantage that the cross traverses remain in the transfer system during the tooling change. If, for weight saving reasons, the cross traverses are manufactured of an expensive material (e.g., carbon fiber composite material), no separate cross traverses need be held in front for different tooling variants, thereby saving costs.

To the extent that it takes over the task of the tooling change, the control device is formed by the machine control. This is, for example, a programmed microprocessor control. The required triggering of the rotary drive device of the height adjusting device and the query whether the driving device for the transfer curve is in the desired position as well as optionally the change into this position is preferably made by a program section of a program implemented in this control. The implementation of the tooling change according to the present invention can therefore take place while utilizing existing hardware components of the multistation press or forming machine. In this case, the solution is particularly simple and also robust.

Other objects, advantages and novel features of the present invention will become apparent from the following detailed description of the invention when considered in conjunction with the accompanying drawings.

DETAILED DESCRIPTION OF THE DRAWINGS

Figure 1:
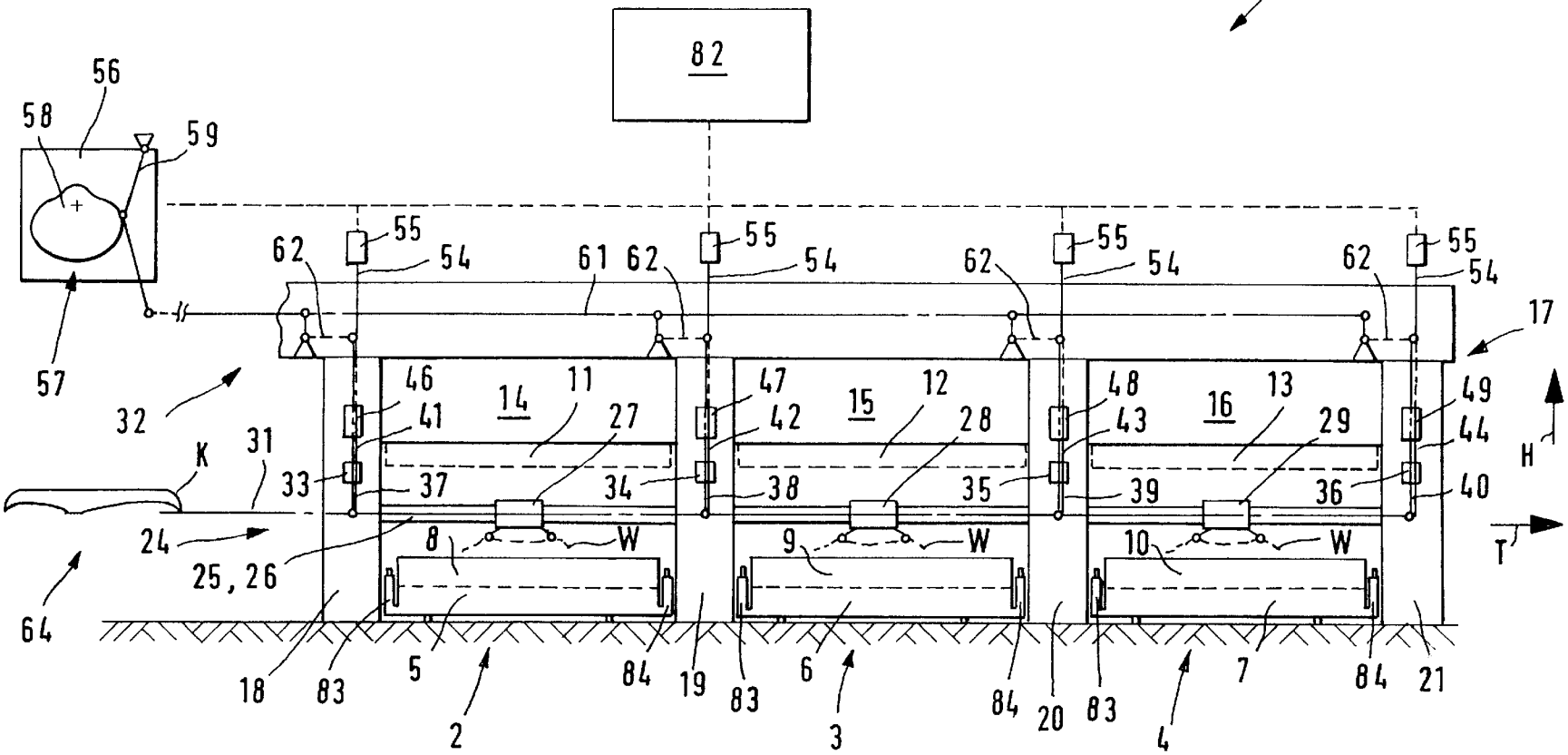
FIG. 1 is a schematic side view of a multi-station forming machine (e.g., a multistation press) with a transfer device and an additional height adjusting device in accordance with the present invention.

FIG. 1 illustrates a multistation press 1 with press stations, of which three press stations 2, 3, 4 are shown. Each press station 2, 3, 4 includes a respective sliding table 5, 6, 7 which carries a bottom tool 8, 9, 10 which is schematically outlined. A top tool 11, 12, 13 respectively is assigned to each of the bottom tools 8, 9, 10 and is held on a press slide 14, 15, 16.

Each press slide 14, 15, 16 is vertically movably disposed in a press frame 17 which is outlined in FIG. 1 by press stands 18, 19, 20 and a press head 22. In a known manner, the slides 14, 15, 16 are operated in a conventional manner by eccentric drives which are driven from a central main shaft.

During the operation of the multistation press 1, the workpieces W to be machined are to be transported in a transport direction T through the succession of press stations 2, 3, 4. For this purpose, transfer device 24 is constructed as a two-axis transfer. The transfer device 24 includes two mutually parallel carrying rails 25, 26 which extend in the transport direction T and which, viewed in the transport direction, each extend on the right side and on the left side past each slide 14, 15, 16 longitudinally through the multistation press 1. Both carrying rails 25, 26 are arranged in a common horizontal plane.

Moving carriages 27, 28, 29 are disposed on the carrying rails 25, 26 in a longitudinally movable manner. By way of schematically shown connecting rods 31, the moving carriages 27, 28, 29 are connected with a driving device which is used for positioning the moving carriages 27, 28, 29 in the transport direction T. This driving device is preferably a conventional-type cam gear which contains a cam plate driven by the main press drive and which acts upon the connecting rod by way of a curve following device and corresponding transmission levers as well as a transmission linkage. While the moving carriages 27, 28, 29 are moved in the transport direction T, the carrying rails 25, 26 are disposed to be indisplaceable or fixed in the transport direction T.

Figure 1A:
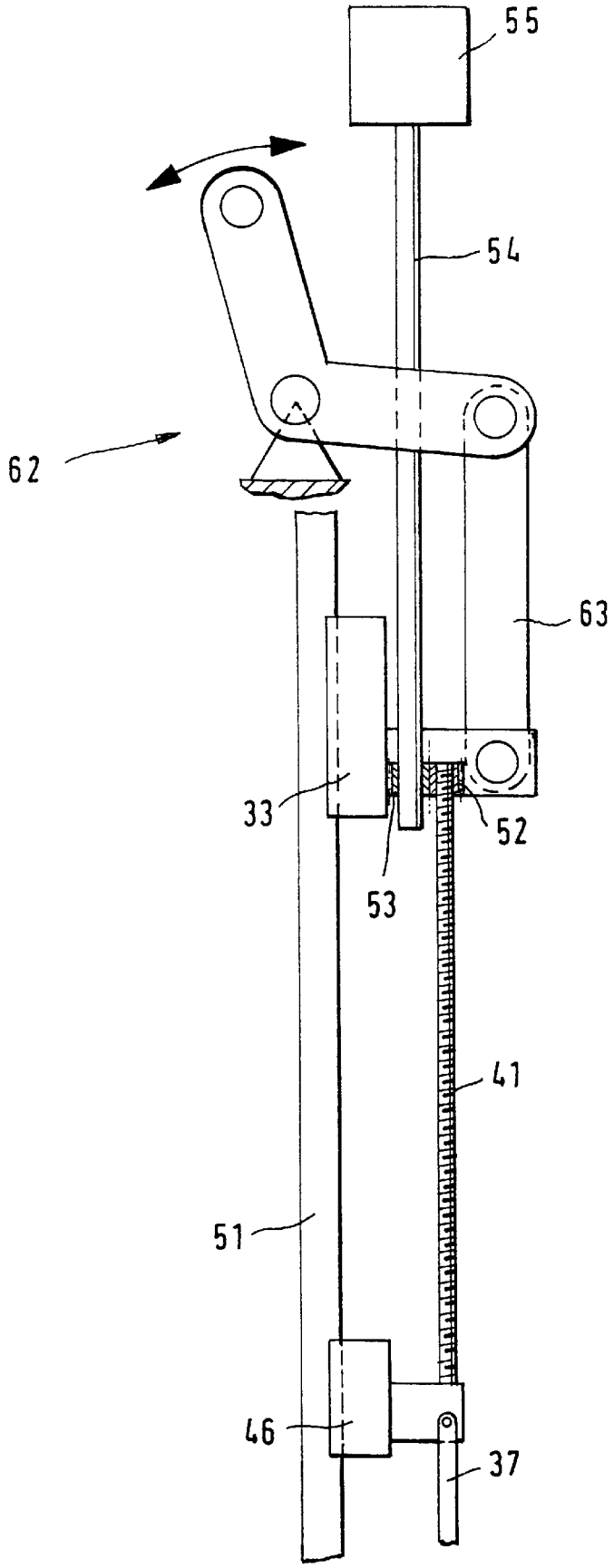
FIG. 1*a* is a diagram of the height adjusting device of the multistation press shown in FIG. 1.

For moving the moving carriages 27, 28, 29 in the lifting direction H (vertical direction), the multistation press 1 is provided with a lifting device 32 which is part of the transfer device 24. On each press stand 18, 19, 20, 21, the lifting device 32 has a vertically displaceably disposed carriage 33, 34, 35, 36 each of which carries the carrying rail 25 or 26 either by way of a bracket or rod 37, 38, 39, 40 or directly. The vertically movably disposed carriages 33, 34, 35, 36 are each connected by a threaded spindle 41, 42, 43, 44 with an also vertically displaceably disposed carriage 46, 47, 48, 49. The carriages which are disposed on each press stand 18, 19, 20, 21 and the connections between these have the same construction and are illustrated in FIG. 1*a* on the example of the carriages 33 and 46.

The spacing of the carriages 33, 46 with respect to one another which are disposed on a joint guide 51 can be adjusted by the rotation of the threaded spindle 41. The threaded spindle 41 is rotatably but axially indisplaceably disposed or fixed on the lower carriage 46. On the upper carriage 33, the threaded spindle is fixed in a rotatably disposed nut 52 which, in turn, is axially indisplaceably disposed on the carriage 33. An external toothing connects the nut 52 with a pinion 53, which is disposed on a sliding shaft 54, in a non-rotatable, axially displaceable manner. This sliding shaft 54, which extends parallel to the threaded spindle 41, is driven by a motor 55. The rotation of the motor 55 causes the spacing between the two carriages 33, 46 therefore to be changed in a targeted manner. As unit coupled by the threaded spindle 41, however, the carriages 33, 46 are vertically freely movable, whereby the pinion 53 will then slide on the sliding shaft 54.

For adjusting the carrying rails 25, 26 in the case of the passage through a transfer curve K shown to the left in FIG. 1, a cam gear 57 is provided with a corresponding drive 56. This cam gear 57 includes a cam plate 58 which is driven by the drive 56 and on which a swivel lever 59 rests as a curve following device. The drive 56 may be the main drive of the press. The drive 56 can also be connected by transmissions and/or coupling devices with the main drive of the press. A separate drive is also contemplated in each case, during a normal operation of the multistation press 1, a synchronizing taking placed between the drive of the slides 14, 15, 16 and the drive 56. The swivel lever 59 transmits its back-and-forth movement by way of corresponding pressing rods 61 to angle levers 62 which, on their other end, are connected by a corresponding bracket 63 with the respective upper carriage 33 to 36.

Together with the lifting device 32 and the connecting rod as well as the associated driving device, the drive 56 forms a drive unit 64 which guides the moving carriages 27, 28, 29 on the transfer curve K. Between two moving carriages 27, 27' (FIG. 3*a*), respectively, one being arranged on the transport rail 25 and the other being arranged on the transport rail 26, a cross traverse 66, 67 respectively is arranged which is illustrated, for example, in FIG. 2.

Each cross traverse 66, 67 carries one or several frames 68 on which suction arms 69, 70 are arranged transversely to the cross traverse 66, 67. Each suction arm 69, 70 is provided on the end side with a suction device 71, 72 for the temporary holding of the workpieces W. Together with the suction arms 69, 70 and the suction devices 71, 72, the frames 68 form so-called suction spiders. These are a workpiece-specific tooling which must also be changed during the tool change.

Figure 2:
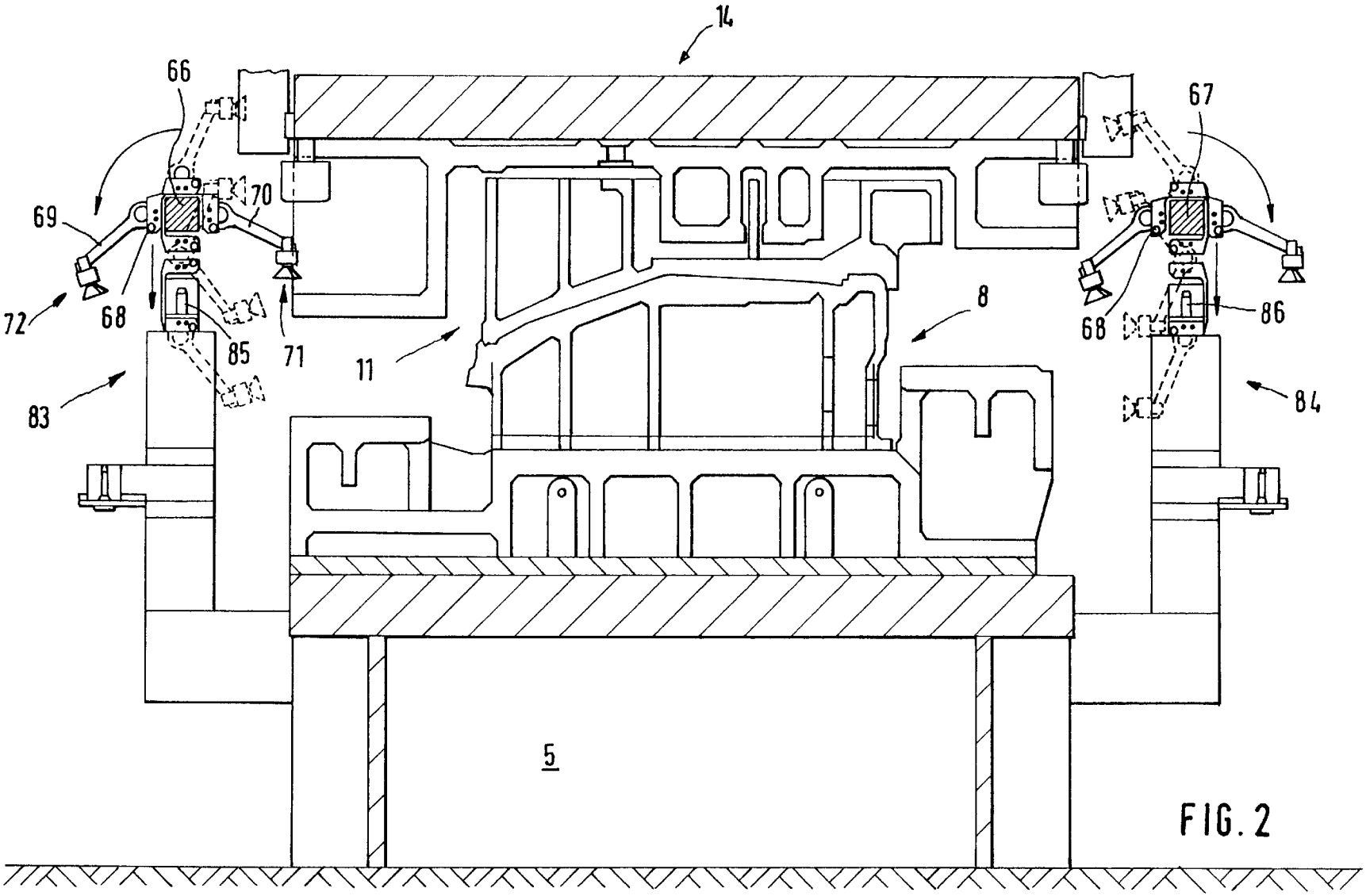
FIG. 2 is a simplified side view of a press station with a sliding table and a tool disposed on it as well as with tooling receiving devices and the tooling to be transferred in different transfer positions.
Figure 3:
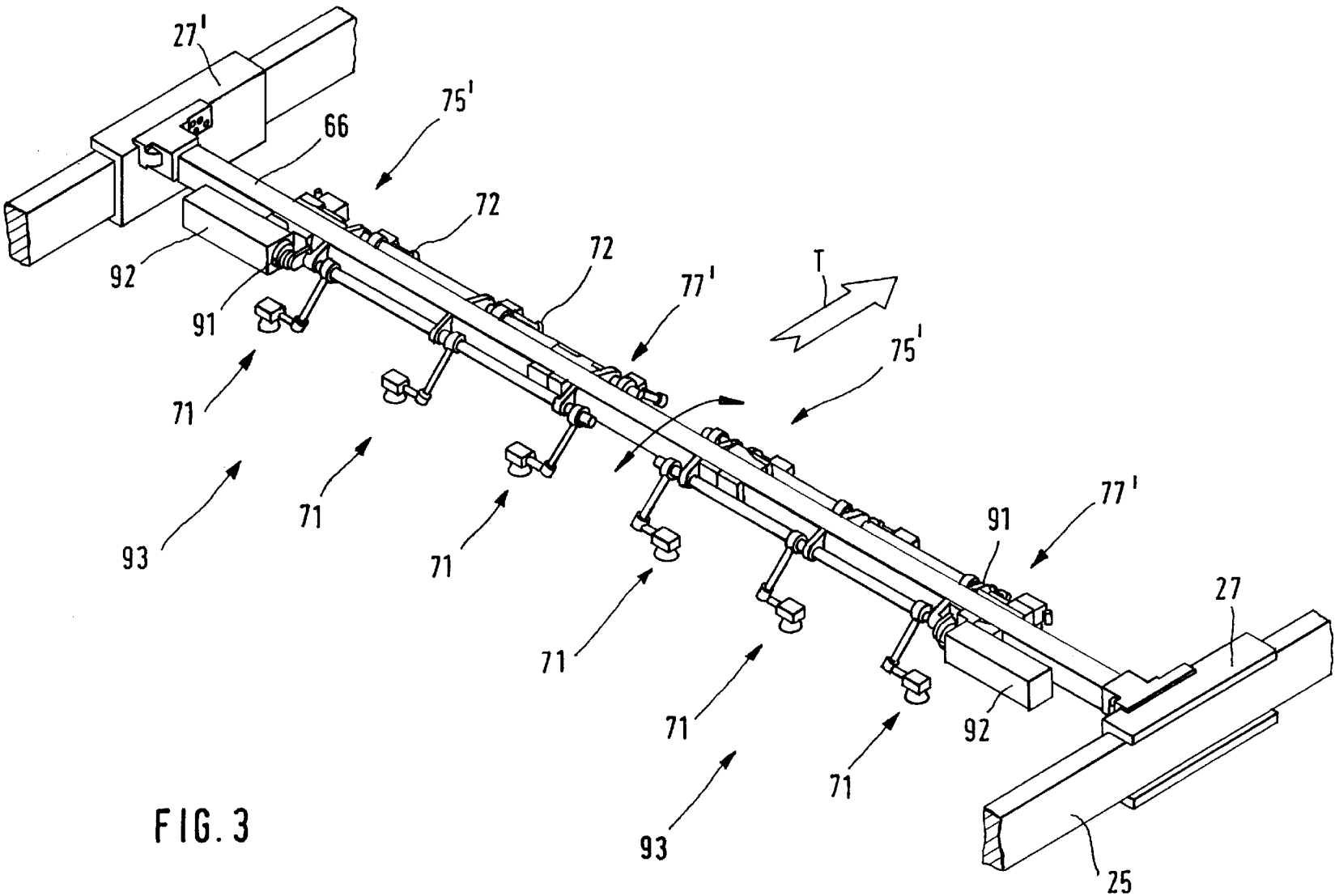
FIG. 3 is an isolated view of an embodiment of a transfer device in accordance with the present invention with cross traverses which carry a rotationally positionable tooling.
Figure 3A:
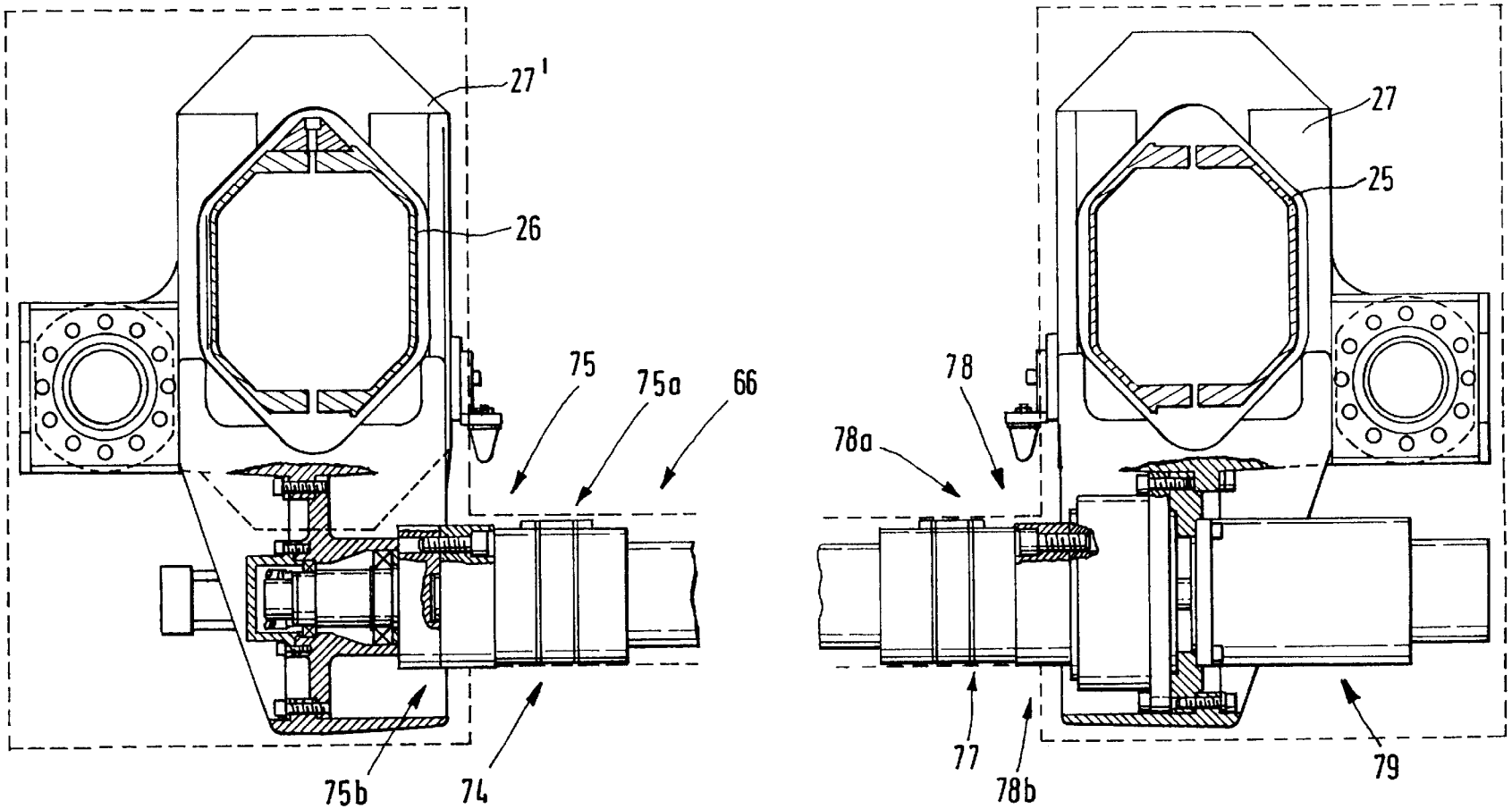
FIG. 3*a* is a cross-sectional, isolated view of the transfer device in the area of each moving carriage.
Figure 4A:
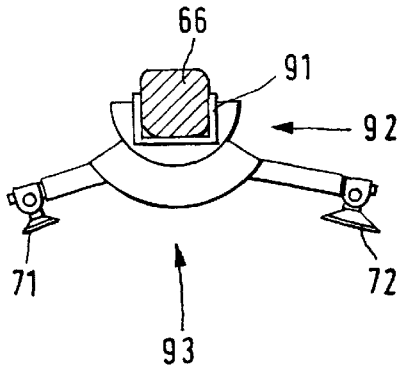
FIGS. 4*a* to 4*d* are schematic side views of the cross traverse and of the tooling of FIG. 3 in different positions during the tooling transfer from the cross traverse to the tooling receiving device.
Figure 4B:
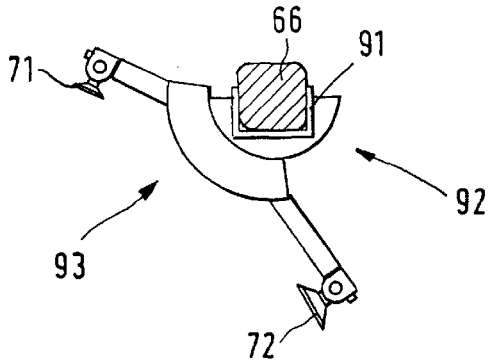
Figure 4C:
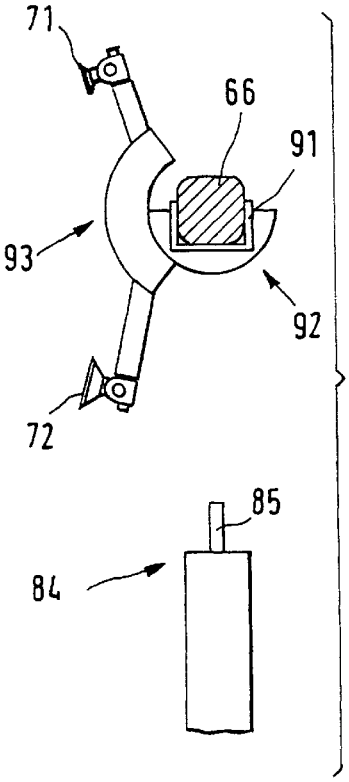
Figure 4D:
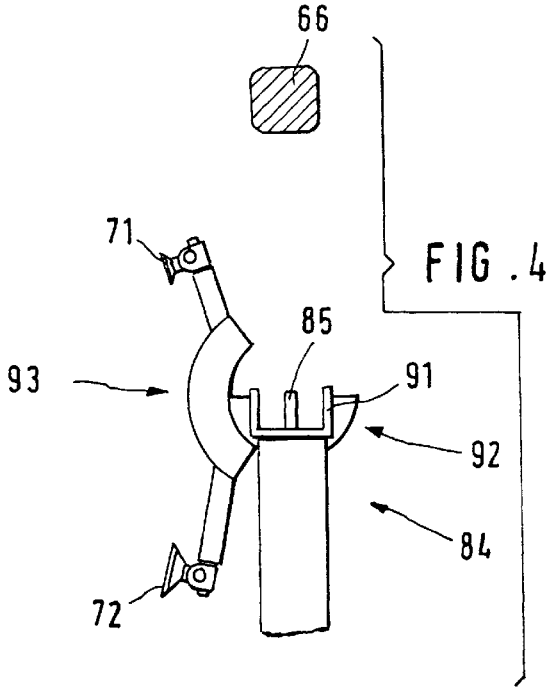

In the embodiments illustrated in FIGS. 1 and 2, the cross traverses 66, 67 are rotatably about a transverse axis disposed between the moving carriage 27, 28 on the carrying rail 25 and the moving carriage 27' on the moving rail 26, as illustrated in FIG. 3*a*. On its end 74 on the left side in the illustration, the cross traverse 66 is connected by way of a controlled coupling device 75 with the moving carriage 27'. One coupling half 75*a* is connected with the cross traverse 66 and the other coupling half 75*b* is connected with the moving carriage 27'. The coupling half 75*b* is rotatably disposed on the moving carriage 27'.

The opposite end 77 is also connected with the moving carriage 27 by way of a releasable coupling 78. Here, a coupling half 78*a* is connected with the cross traverse and the other coupling half 78*b* is connected with a rotary drive 79 carried by the moving carriage 27. This rotary drive 79 positions the cross traverse 66 can be positioned in a targeted manner about its transverse axis.

While the rotary drive 79 form a rotary drive device for the suction spiders, the above-described motors 55 and the threaded spindles 41, 42, 43, 44 driven thereby form a height adjusting device. The rotary drive 79 as well as the height adjusting device formed by the motors 55 and the respective spindles 41, 42, 43, 44, can be controlled independently of the driving device 64. A control device 82 effects the triggering which may be part of an already existing electric machine control system. The control device 82 controls the motors 55 for adjusting the height of the carrying rails 25, 26 and the rotary drives 79 for adjusting the angular position. In addition, the control device 82 controls the driving device 64 or at least queries its position. The control device 82 is constructed such that, by way of the components of the multistation press 1 described so far, a transfer of the cross traverses 66, 67 or of the suction spiders to tooling deposits 83, 84 is carried out without the aid of a transfer unit. The tooling deposits 83, 84 provided for receiving the tooling, as illustrated in FIG. 2, are provided on the sliding tables 5, 6, 7. They are formed by alignment pins 85, 86 or the like which are stationarily disposed on the respective sliding table 5, 6, 7 and project stationarily vertically upward. They are purely passive and take over the tooling without the interposition of any type of transfer unit.

The multistation press 1 operates during the tool and tooling change as follows. For the tool change, the control device 82 examines whether the cross traverses 66, 67 are held above the tooling deposits 83, 84. If the position differs, the driving device 64 is operated such that the moving carriages 27, 28, 29 are moved and the cross traverses 66, 67 come to be situated above the tooling deposits 83, 84.

In the next step, as shown in FIG. 2, the rotary drives 7 are controlled such that the cross traverses 66, 67 swivel by 90°. Thereby, the suction arms 69, 70 tilt into a more or less depositing vertical position.

For transferring the toolings to the tooling deposits 83, 84, the control device 82 activates the motors 55 which, by way of the threaded spindles 41, 42, 43, 44, enlarge the distances between the upper carriages 46, 47, 48, 49 and the lower carriages 33, 34, 35, 36 so that the carrying rails 25, 26 move downward. Thereby, the cross traverses 66, 67 are deposited by corresponding openings on the alignment pins 85, 86. The control device 82 now opens up the couplings 75, 77, after which the carrying rails 25, 26 are moved upwards again by the triggering of each of the motors 55. The tooling is therefore deposited on the sliding tables 5, 6, 7 and, thereby, can be moved out of the multistation press 1.

In an alternative embodiment to that illustrated in FIG. 3, only the suction spiders are deposited on corresponding tooling deposits 83, 84, in which case the traverse 66 remains in the transfer device. To the extent that this alternative embodiment coincides with the above-described embodiment, the above description applies correspondingly and the same reference numbers are used. Deviating from the above-described embodiment, the cross traverses 66 are non-rotatably held on the moving carriages 27, 27'. On the cross traverse 66, a corresponding frame 91 is held by way of releasable coupling devices 75', 77' and carries suction spiders 93 by way of rotary drives 92, the suction devices 71, 72 are held on the suction spiders 93.

The approach during the tooling change is illustrated for this alternative embodiment in FIGS. 4*a* to 4*d*. During the normal operation of the multistation press 1, the tooling takes up the position illustrated in FIG. 4*a*. In order to deposit the tooling on the tooling deposit 84, the rotary drive 92 is activated so that the suction spider 93 moves through the position shown in FIG. 4*b* into the position shown in FIG. 4*c*. For depositing the tooling on the tooling deposit 84, the control device 82 now triggers the motors 55 so that the cross traverse 66 moves downward and deposits the frame 91 with the suction spider 93 on the tooling deposit 84. The frame 91 is then removed from the alignment pins 85, and thereafter the control device 82 reverses the motors 55 so that the cross traverse moves upward again.

In summary, a multistation press 1 has a transfer device 24 with cross traverses 66, 67. The transfer device 24 is set up for the automatic tooling change. For this purpose, the cross traverses 66, 67 or the tooling held thereon are to be deposited on passive tooling receiving devices 83, 84 on the sliding tables 5, 6, 7. This takes place without the aid of transfer units in that the control device 82 activates a height adjusting device 81 which is independent of the other driving devices 64 for the workpiece transfer. Thereby the cross traverses are lowered to the passive tooling receiving devices 83, 84.

The foregoing disclosure has been set forth merely to illustrate the invention and is not intended to be limiting. Since modifications of the disclosed embodiments incorporating the spirit and substance of the invention may occur to persons skilled in the art, the invention should-be construed to include everything within the scope of the appended claims and equivalents thereof.

What is claimed is:

1. Forming machine including multistation press comprising:

a plurality of working stations arranged one behind another in a transport direction and through which workpieces successively pass, tables, arranged to be movable out of the working stations, and equipped with devices for receiving tools and carrying tooling receiving devices, a transfer device for transporting the workpieces among the working stations, the transfer device having at least two carrying rails extending essentially parallel to the transport direction, cross traverses operatively arranged between the carrying rails and carrying a tooling with holding devices for controlled holding and releasing of the workpieces, at least one driving device configured to move the cross traverses on a defined transfer curve and having height adjusting devices configured to permit vertical adjustment of the cross traverses, rotary drive devices for controlled rotation of the holding devices about an axis oriented transversely with respect to the transport direction, a control device configured to control at least operation of the height adjusting device and of the rotary drive devices, wherein, for depositing at least one of the cross traverses and the tooling held by the cross traverses during the tool change, the rotary drive device is caused to lower the tooling into a depositing position, and the height adjusting device will cause, for the transfer of at least one of the cross traverses and of the tooling to the tooling receiving devices, the carrying rails to be lowered vertically to the position of the tooling receiving devices.

2. Forming machine according to claim 1, wherein, on the carrying rails, longitudinally movably disposed moving carriages are connected with one end respectively of the cross traverse.

3. Forming machine according to claim 2, wherein the cross traverses are connected with the moving carriages via coupling devices which are controllably releasable.

4. Forming machine according to claim 3, wherein the control device is arranged to control the coupling devices.

5. Forming machine according to claim 1, wherein the height adjusting device comprises at least one device configured to be controllably longitudinally adjustable and, with respect to its effect, is arranged between the driving device and the carrying rails.

6. Forming machine according to claim 5, wherein the device comprises screw spindles for connecting the carrying rail with vertically displaceably disposed carriages which are vertically movable by the driving device corresponding to the transfer curve.

7. Forming machine according to claim 2, wherein the driving device comprises a cam gear which has at least one cam plate for a vertical component of the transfer curve and at least one other cam plate for a transport direction component of the transfer curve, a curve following device for the vertical component operatively connected with the carrying rails, and a curve following device for the transport direction component operatively connected with the running carriages, and the height adjusting device being constructed separately from the driving device and configured for adjusting the vertical position of the transfer curve.

8. Forming machine according to claim 1, wherein the rotary drive device comprises rotary drives arranged on the moving carriages.

9. Forming machine according to claim 1, wherein the rotary drive device comprises rotary drives arranged on the cross traverses.

10. Forming machine according to claim 1, wherein the tooling receiving devices have a passive construction.

11. Forming machine according to claim 1, wherein the control device is configured such that the transfer of the tooling takes place from the transfer system directly to the tooling receiving devices.

12. Forming machine according to claim 1, wherein the control device comprises a program implementable machine control.

* * * * *